US009653032B2

(12) United States Patent
Lin et al.

(10) Patent No.: US 9,653,032 B2
(45) Date of Patent: May 16, 2017

(54) LIQUID CRYSTAL PIXEL CIRCUIT OF LIQUID CRYSTAL DISPLAY PANEL AND DRIVING METHOD THEREOF

(71) Applicant: Au Optronics Corporation, Hsinchu (TW)

(72) Inventors: Chih-Lung Lin, Tainan (TW); Chia-En Wu, Chiayi (TW); Mao-Hsun Cheng, Tainan (TW); Bo-Shiang Tzeng, Kaohsiung (TW); Ching-Huan Lin, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 361 days.

(21) Appl. No.: 14/480,641

(22) Filed: Sep. 9, 2014

(65) Prior Publication Data

US 2015/0277177 A1 Oct. 1, 2015

(30) Foreign Application Priority Data

Mar. 28, 2014 (TW) ..... 103111793 A

(51) Int. Cl.

| | |
|---|---|
| ***G09G 5/00*** | (2006.01) |
| ***G09G 5/10*** | (2006.01) |
| ***G09G 3/36*** | (2006.01) |

(52) U.S. Cl.

CPC ..... *G09G 3/3648* (2013.01); *G09G 2310/06* (2013.01); *G09G 2320/0252* (2013.01)

(58) Field of Classification Search

CPC ... G09G 5/00; G09G 5/10; G09G 3/36; G02F 1/13; G02F 1/133; G02F 1/1333; G02F 1/1337; G02F 1/1343; G02F 1/1362; G02F 1/1368

See application file for complete search history.

(56) References Cited

U.S. PATENT DOCUMENTS

| | | | | |
|---|---|---|---|---|
| 6,476,786 | B1 * | 11/2002 | Miyachi | G09G 3/3648 345/90 |
| 7,768,589 | B2 | 8/2010 | Miyachi et al. | |
| 8,674,975 | B2 | 3/2014 | Chuang et al. | |
| 2003/0052847 | A1 | 3/2003 | Okishiro et al. | |

(Continued)

FOREIGN PATENT DOCUMENTS

TW 201227697 7/2012

*Primary Examiner* — Ilana Spar
*Assistant Examiner* — Nguyen H Truong
(74) *Attorney, Agent, or Firm* — Jianq Chrun IP Office

(57) ABSTRACT

A liquid crystal (LC) pixel circuit of a LC display panel includes a first, a second, a third and a fourth switches, a LC capacitor and a storage capacitor. A first and a control terminals of the first switch respectively receive a common voltage and a first gate signal. A first and a control terminals of the second switch respectively receive a data voltage and a second gate signal. The storage capacitor and the LC capacitor electrically connect between second terminals of the first and second switches. A first and a control terminals of the third switch respectively receive the common voltage and a third gate signal. A first and a control terminals of the fourth switch respectively receive a set voltage and a fourth gate signal. Second terminals of the third and the fourth switches respectively connect to the second terminals of the second and the first switches.

13 Claims, 2 Drawing Sheets

(56) References Cited

U.S. PATENT DOCUMENTS

| | | | | |
|---|---|---|---|---|
| 2008/0136983 | A1* | 6/2008 | Huang | G09G 3/3659 349/38 |
| 2010/0182523 | A1* | 7/2010 | Woo | G02F 1/134363 349/37 |
| 2010/0225569 | A1* | 9/2010 | Park | G02F 1/134336 345/87 |
| 2012/0169694 | A1* | 7/2012 | Chuang | G09G 3/3655 345/211 |

* cited by examiner

LIQUID CRYSTAL PIXEL CIRCUIT OF LIQUID CRYSTAL DISPLAY PANEL AND DRIVING METHOD THEREOF

CROSS-REFERENCE TO RELATED APPLICATION

This application claims the priority benefit of Taiwan application serial no. 103111793, filed on Mar. 28, 2014. The entirety of the above-mentioned patent application is hereby incorporated by reference herein and made a part of this specification.

BACKGROUND OF THE INVENTION

Field of the Invention

The invention relates to a liquid crystal pixel circuit and a driving method thereof, and more particularly relates to a liquid crystal pixel circuit capable of increasing an operating voltage range and a driving method thereof.

Description of Related Art

With the vigorous development of display technology, the standard that the users hold for display image quality gets higher and higher. Responsive to the users' demands with respect to the response time of a display, there are more and more manufacturers in the field of displays investing in the development of blue phase liquid crystal (BPLC) displays.

Blue phase liquid crystal display is superior to the traditional liquid crystal in response speed and has great potential in improving the image effect of the liquid crystal display. However, for blue phase liquid crystal, the data voltage of the general liquid crystal pixel circuit is relatively low, which may cause the blue phase liquid crystal to have insufficient transmittance, and as a result, a higher operating voltage is required for use of blue phase liquid crystal.

SUMMARY OF THE INVENTION

The invention provides a liquid crystal pixel circuit and a driving method thereof for improving an operating voltage range of liquid crystal in the liquid crystal pixel circuit.

The liquid crystal pixel circuit of the invention includes a first switch, a second switch, a storage capacitor, a liquid crystal capacitor, a third switch, and a fourth switch. The first switch includes a first terminal, a second terminal, and a control terminal, wherein the first terminal of the first switch receives a common voltage and the control terminal of the first switch receives a first gate signal. The second switch includes a first terminal, a second terminal, and a control terminal, wherein the first terminal of the second switch receives a data voltage and the control terminal of the second switch receives a second gate signal. The storage capacitor is electrically coupled between the second terminal of the first switch and the second terminal of the second switch. The liquid crystal capacitor is electrically coupled between the second terminal of the first switch and the second terminal of the second switch. The third switch includes a first terminal, a second terminal, and a control terminal, wherein the first terminal of the third switch receives the common voltage, the second terminal of the third switch is electrically coupled with the second terminal of the second switch, and the control terminal of the third switch receives a third gate signal. The fourth switch includes a first terminal, a second terminal, and a control terminal, wherein the first terminal of the fourth switch receives a set voltage, the second terminal of the fourth switch is electrically coupled with the second terminal of the first switch, and the control terminal of the fourth switch receives a fourth gate signal.

In an embodiment of the invention, the second gate signal and the third gate signal are reversed phases, and the second gate signal is the same as the fourth gate signal.

In an embodiment of the invention, the first switch, the second switch, the third switch, and the fourth switch are transistors respectively.

The invention provides a driving method of a liquid crystal pixel circuit, and the driving method includes the following steps. The liquid crystal pixel circuit, including a liquid crystal capacitor and a storage capacitor coupled in parallel, is provided. A common voltage is provided to a first terminal and a second terminal of the liquid crystal capacitor in a first period. A data voltage is provided to the first terminal of the liquid crystal capacitor and a set voltage is provided to the second terminal of the liquid crystal capacitor in a second period. The common voltage is provided to the first terminal of the liquid crystal capacitor in a third period. The first period precedes the second period, and the second period precedes the third period.

In an embodiment of the invention, the liquid crystal pixel circuit further includes a first switch, a second switch, a third switch, and a fourth switch that are respectively controlled by a first gate signal, a second gate signal, a third gate signal, and a fourth gate signal; and the driving method further includes: in the first period, the first gate signal forms a first positive pulse wave to turn on the first switch; the third gate signal is an enabling level to turn on the third switch; and the common voltage is transmitted to the first terminal and the second terminal of the liquid crystal capacitor by turning on the first switch and the third switch. In the second period, the second gate signal and the fourth gate signal form a second positive pulse wave to turn on the second switch and the fourth switch; the third gate signal forms a negative pulse wave to turn off the third switch; the data voltage is transmitted to the first terminal of the liquid crystal capacitor by turning on the second switch and the set voltage is transmitted to the second terminal of the liquid crystal capacitor by turning on the fourth switch. In the third period, the third gate signal is the enabling level to turn on the third switch; the first gate signal and the second gate signal are a disabling level to turn off the first switch, the second switch, and the fourth switch; and the common voltage is transmitted to the first terminal of the liquid crystal capacitor by turning on the third switch.

In an embodiment of the invention, the liquid crystal capacitor is formed by blue phase liquid crystal, nematic liquid crystal, smectic liquid crystal, or cholesteric liquid crystal.

In an embodiment of the invention, the liquid crystal pixel circuit is a liquid crystal pixel circuit of a TN liquid crystal display panel, a VA liquid crystal display panel, an IPS liquid crystal display panel, or a FFS liquid crystal display panel.

Based on the above, the liquid crystal pixel circuit and the driving method thereof provided by the embodiments of the invention improve the operating voltage range of the liquid crystal in the liquid crystal pixel circuit by the DC voltage set externally and the capacitive coupling effect.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
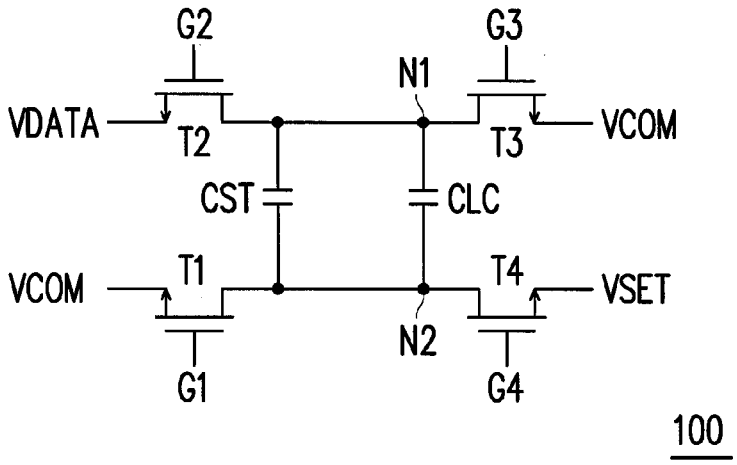
FIG. 1 is a circuit diagram of a liquid crystal pixel circuit according to an embodiment of the invention.

FIG. 1 is a circuit diagram of a pixel circuit 100 adapted for a liquid crystal display panel according to an embodiment of the invention. With reference to FIG. 1, in this embodiment, the pixel circuit 100 includes a first switch T1, a second switch T2, a storage capacitor CST, a liquid crystal capacitor CLC, a third switch T3, and a fourth switch T4. A first terminal of the first switch T1 receives a common voltage VCOM and a control terminal of the first switch T1 receives a first gate signal G1. A first terminal of the second switch T2 receives a data voltage VDATA and a control terminal of the second switch T2 receives a second gate signal G2. The storage capacitor CST and the liquid crystal capacitor CLC are coupled in parallel and are electrically coupled between a second terminal of the first switch T1 and a second terminal of the second switch T2. That is, a second terminal N2 of the liquid crystal capacitor CLC is electrically coupled with the second terminal of the first switch T1, and a first terminal N1 of the liquid crystal capacitor CLC is electrically coupled with the second terminal of the second switch T2. The aforementioned liquid crystal display panel includes a TN liquid crystal display panel, a VA liquid crystal display panel, an IPS liquid crystal display panel, and a FFS liquid crystal display panel. Nevertheless, it is noted that the invention is not limited thereto.

A first terminal of the third switch T3 receives the common voltage VCOM, a second terminal of the third switch T3 is electrically coupled with the second terminal of the second switch T2, and a control terminal of the third switch T3 receives a third gate signal G3. A first terminal of the fourth switch T4 receives a set voltage VSET, a second terminal of the fourth switch T4 is electrically coupled with the second terminal of the first switch T1, and a control terminal of the fourth switch T4 receives a fourth gate signal G4. In this embodiment, the switches (e.g. T1 to T4) are transistors respectively, for example, which are turned on when the respective control terminals receive an enabling level (e.g. high voltage level). The liquid crystal capacitor CLC is formed by blue phase liquid crystal, nematic liquid crystal, smectic liquid crystal, or cholesteric liquid crystal, for example. The set voltage VSET may be a DC voltage inputted externally for adjusting a voltage difference between two terminals of the liquid crystal capacitor CLC.

In this embodiment, the liquid crystal pixel circuit 100 first turns on the first switch T1 and the third switch T3 to transmit the common voltage VCOM to the first terminals N1 and the second terminals N2 of the liquid crystal capacitor CLC and the storage capacitor CST, so as to reduce a charging range for the liquid crystal capacitor CLC and the storage capacitor CST. Then, the second switch T2 is turned on to transmit the data voltage VDATA to the first terminals N1 of the liquid crystal capacitor CLC and the storage capacitor CST. Meanwhile, the fourth switch T4 is turned on to transmit the set voltage VSET to the second terminals N2 of the liquid crystal capacitor CLC and the storage capacitor CST, so as to determine the voltage difference on the liquid crystal capacitor CLC according to a voltage difference between the set voltage VSET and the data voltage VDATA, thereby adjusting and effectively improving an operating voltage range of the liquid crystal in the liquid crystal pixel circuit 100. Thereafter, the third switch T3 is turned on to transmit the common voltage VCOM to the first terminals N1 of the liquid crystal capacitor CLC and the storage capacitor CST to serve as a voltage reference value.

It is noted that turn-on of the switches (e.g. T1 to T4) may be respectively determined by the gate signals (e.g. G1 to G4) received by the control terminals of the respective switches. In an embodiment, the second gate signal G2 and the third gate signal G3 may be set to be reversed phases while the second gate signal G2 may be set to be the same as the fourth gate signal G4. In addition, the liquid crystal pixel circuit 100 may be one of the liquid crystal pixel circuits in an $N^{th}$ row of a pixel array. The liquid crystal pixel circuits in the $N^{th}$ row are jointly controlled by an $N^{th}$ gate signal to be turned on or off. Therefore, the liquid crystal pixel circuit 100 of this embodiment may use an $N-1^{th}$ gate signal as the first gate signal G1, uses the $N^{th}$ gate signal as the second gate signal G2 and the fourth gate signal G4, and uses a reversed phase signal of the $N^{th}$ gate signal as the third gate signal G3. In the embodiments of the invention, i may be a positive integer greater than or equal to 1. Nevertheless, the invention is not limited thereto.

Figure 2:
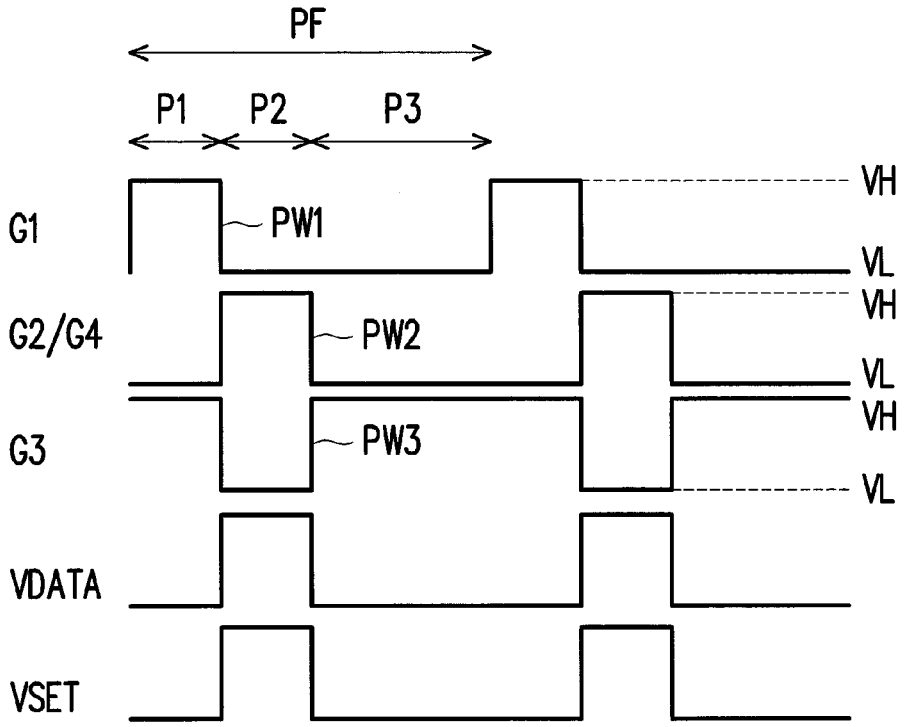
FIG. 2 is a schematic diagram illustrating driving waveforms of a liquid crystal pixel circuit according to an embodiment of the invention.

Next, how the liquid crystal pixel circuit 100 adjusts the operating voltage range of the liquid crystal through the gate signals (e.g. G1 to G4) is explained in detail with reference to the driving waveform diagram of FIG. 2. With reference to FIG. 1 and FIG. 2, in this embodiment, a frame period PF of the liquid crystal pixel circuit 100 includes a first period P1, a second period P2, and a third period P3 in sequence. The gate signals (e.g. G1 to G4) form a positive pulse wave (e.g. PW1, PW2) or a negative pulse wave (e.g. PW3) in the frame period PF. A high voltage level of the pulse waves may be set to a high voltage VH while a low voltage level thereof may be set to a low voltage VL. In other embodiments, the high voltage level and the low voltage level corresponding to the pulse waves may not be the same. Moreover, the data voltage VDATA may correspond to a random voltage in a specific voltage range according to the corresponding image data, which may be determined by those skilled in the art. Nevertheless, the invention is not limited to the above. The set voltage VSET may correspond to a random voltage in another specific voltage range, and the voltage level of the set voltage VSET may be determined by those who apply this embodiment according to their requirements of the liquid crystal pixel operating voltage range.

In the first period P1, the first gate signal G1 forms the first positive pulse wave PW1 to turn on the first switch T1; the third gate signal G3 is an enabling level (e.g. the high voltage VH) to turn on the third switch T3; and the second gate signal G2 and the fourth gate signal G4 are a disabling level (e.g. the low voltage VL) to turn off the second switch T2 and the fourth switch T4. Meanwhile, the common voltage VCOM is respectively transmitted to the first terminal N1 and the second terminal N2 of the liquid crystal capacitor CLC by turning on the first switch T1 and the third switch T3. In other words, the first terminal N1 and the second terminal N2 of the liquid crystal capacitor CLC have the same voltage. Thus, a cross voltage of the storage capacitor CST and the liquid crystal capacitor CLC is gradually reduced or even eliminated. On the other hand, the aforementioned transmission of the common voltage VCOM to the first terminal N1 and the second terminal N2 of the liquid crystal capacitor CLC is equivalent to simultaneously precharging the first terminal N1 and the second terminal N2 of the liquid crystal capacitor CLC to the voltage level of the common voltage VCOM. In comparison with charging one single terminal of the capacitor, the embodiment of the invention, which simultaneously charges both terminals of the capacitor, increases a charging speed of the liquid crystal pixel.

In the second period P2, the second gate signal G2 and the fourth gate signal G4 form the second positive pulse wave PW2 to turn on the second switch T2 and the fourth switch T4; the third gate signal G3 forms the negative pulse wave PW3 to turn off the third switch T3; and the first gate signal G1 is the disabling level (e.g. the low voltage VL) to turn off the first switch T1. At the moment, the data voltage VDATA is transmitted to the first terminal N1 of the liquid crystal capacitor CLC by turning on the second switch T2, and the set voltage VSET is transmitted to the second terminal N2 of the liquid crystal capacitor CLC by turning on the fourth switch T4. That is, the voltage difference between the set voltage VSET and the data voltage VDATA at this moment determines the cross voltage of the liquid crystal capacitor CLC.

In the third period P3, the third gate signal G3 is the enabling level (e.g. the high voltage VH) to turn on the third switch T3; the first gate signal G1 and the second gate signal G2 are the disabling level (e.g. the low voltage VL) to turn off the first switch T1, the second switch T2, and the fourth switch T4. At the same time, the common voltage VCOM is transmitted to the first terminal N1 of the liquid crystal capacitor CLC by turning on the third switch T3. Accordingly, after the set voltage VSET is determined, the liquid crystal pixel circuit 100 of this embodiment adjusts the cross voltage of the liquid crystal capacitor CLC through a capacitive coupling effect. In other words, the cross voltage (i.e. the operating voltage) of the liquid crystal capacitor CLC responds to the voltage difference between the set voltage VSET and the data voltage VDATA. Thus, through voltage level setting of the set voltage VSET, the voltage operating range of the liquid crystal in the liquid crystal pixel circuit 100 is directly and effectively improved.

For example, according to the driving method of the liquid crystal pixel circuit 100 of this embodiment, when the data voltage VDATA is set to 15 volts and the set voltage VSET is set to −5 volts, the cross voltage of the liquid crystal capacitor CLC can be adjusted to 20 volts; and when the data voltage VDATA is set to 0 volt and the set voltage VSET is set to 20 volts, the cross voltage of the liquid crystal capacitor CLC can be adjusted to −20 volts. Accordingly, the operating voltage range of the liquid crystal in the liquid crystal pixel circuit 100 is improved.

Based on the above, this embodiment uses the common voltage VCOM to reset the voltage range of the liquid crystal capacitor CLC in the first period P1 and uses the set voltage VSET and the data voltage VDATA to determine the voltage range of the liquid crystal capacitor CLC in the second period P2. Thereafter, in the third period P3, the common voltage VCOM is provided and transmitted to the first terminal N1 of the liquid crystal capacitor CLC as the reference voltage, such that the set voltage VSET can directly and effectively improve the operating voltage range of the liquid crystal in the liquid crystal pixel circuit 100.

Figure 3:
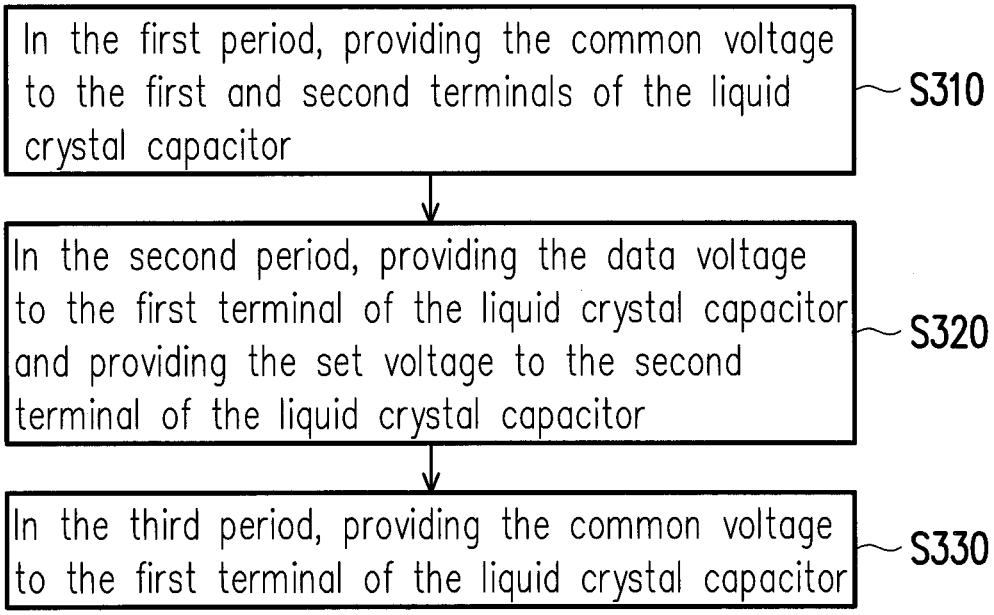
FIG. 3 is a flowchart illustrating a driving method of a liquid crystal pixel circuit according to an embodiment of the invention.

FIG. 3 is a flowchart illustrating a driving method of a pixel circuit according to an embodiment of the invention. With reference to FIG. 3, this embodiment is adapted for the pixel circuit 100 illustrated in FIG. 1. The driving method of the pixel circuit 100 includes the following steps. In the first period P1, the common voltage VCOM is provided to the first terminal and the second terminal of the liquid crystal capacitor CLC (Step S310). In the second period P2, the data voltage VDATA is provided to the first terminal of the liquid crystal capacitor CLC and the set voltage VSET is provided to the second terminal of the liquid crystal capacitor CLC (Step S320). In the third period P3, the common voltage VCOM is provided to the first terminal of the liquid crystal capacitor CLC (Step S330), wherein the first period P1 precedes the second period P2, and the second period P2 precedes the third period P3. It is noted that the order of the steps, as described above, is for illustrative purposes and should not be construed as a limitation to the embodiment of the invention. Details of the above steps have been specified in the embodiments of FIG. 1 to FIG. 2 and therefore are not repeated hereinafter.

To sum up, the liquid crystal pixel circuit and the driving method thereof provided by the embodiments of the invention improve the operating voltage range of the liquid crystal in the liquid crystal pixel circuit by using the DC voltage set externally and the capacitive coupling effect, thereby improving the transmittance of the liquid crystal. Moreover, in the embodiments of the invention, the charging range of the pixel circuit is reduced by precharging, which increases the charging speed of the liquid crystal pixel.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A liquid crystal pixel circuit of a liquid crystal display panel, the liquid crystal pixel circuit comprising:

a first switch comprising a first terminal, a second terminal, and a control terminal, wherein the first terminal of the first switch is configured to receive a common voltage, and the control terminal of the first switch is configured to receive a first gate signal;

a second switch comprising a first terminal, a second terminal, and a control terminal, wherein the first terminal of the second switch is configured to receive a data voltage, and the control terminal of the second switch is configured to receive a second gate signal;

a storage capacitor electrically coupled between the second terminal of the first switch and the second terminal of the second switch;

a liquid crystal capacitor electrically coupled between the second terminal of the first switch and the second terminal of the second switch;

a third switch comprising a first terminal, a second terminal, and a control terminal, wherein the first terminal of the third switch is configured to receive the common voltage, the second terminal of the third switch is electrically coupled with the second terminal of the second switch, and the control terminal of the third switch is configured to receive a third gate signal; and a fourth switch comprising a first terminal, a second terminal, and a control terminal, wherein the first terminal of the fourth switch is configured to receive a set voltage, the second terminal of the fourth switch is electrically coupled with the second terminal of the first switch, and the control terminal of the fourth switch is configured to receive a fourth gate signal.

2. The liquid crystal pixel circuit according to claim 1, wherein the second gate signal and the third gate signal are reversed phases, and the second gate signal is the same as the fourth gate signal.

3. The liquid crystal pixel circuit according to claim 2, wherein the liquid crystal capacitor is formed by blue phase liquid crystal.

4. The liquid crystal pixel circuit according to claim 2, wherein the liquid crystal capacitor is formed by nematic liquid crystal, smectic liquid crystal, or cholesteric liquid crystal.

5. The liquid crystal pixel circuit according to claim 1, wherein the liquid crystal capacitor is formed by blue phase liquid crystal.

6. The liquid crystal pixel circuit according to claim 1, wherein the liquid crystal capacitor is formed by nematic liquid crystal, smectic liquid crystal, or cholesteric liquid crystal.

7. The liquid crystal pixel circuit according to claim 1, wherein the first switch, the second switch, the third switch, and the fourth switch are transistors respectively.

8. The liquid crystal pixel circuit according to claim 1, wherein the liquid crystal pixel circuit is a liquid crystal pixel circuit of a TN liquid crystal display panel, a VA liquid crystal display panel, an IPS liquid crystal display panel, or a FFS liquid crystal display panel.

9. A driving method of applied on the liquid crystal pixel circuit according to claim 1, the driving method comprising:

providing the common voltage to the first terminal and the second terminal of the liquid crystal capacitor in a first period by the first switch and the third switch;

providing the data voltage to the first terminal of the liquid crystal capacitor and providing the set voltage to the second terminal of the liquid crystal capacitor in a second period by the second switch and the fourth switch; and providing the common voltage to the first terminal of the liquid crystal capacitor in a third period by the third switch, wherein the first period precedes the second period, and the second period precedes the third period.

10. The driving method according to claim 9, wherein the driving method further comprises:

in the first period, the first gate signal forming a first positive pulse wave to turn on the first switch; the third gate signal being an enabling level to turn on the third switch; and the common voltage being transmitted to the first terminal and the second terminal of the liquid crystal capacitor by turning on the first switch and the third switch;

in the second period, the second gate signal and the fourth gate signal forming a second positive pulse wave to turn on the second switch and the fourth switch; the third gate signal forming a negative pulse wave to turn off the third switch; the data voltage being transmitted to the first terminal of the liquid crystal capacitor by turning on the second switch and the set voltage being transmitted to the second terminal of the liquid crystal capacitor by turning on the fourth switch; and in the third period, the third gate signal being the enabling level to turn on the third switch; the first gate signal and the second gate signal being a disabling level to turn off the first switch, the second switch, and the fourth switch; and the common voltage being transmitted to the first terminal of the liquid crystal capacitor by turning on the third switch.

11. A driving method of a liquid crystal pixel circuit, the driving method comprising:

providing a liquid crystal pixel circuit comprising a liquid crystal capacitor and a storage capacitor coupled in parallel;

providing a common voltage to a first terminal and a second terminal of the liquid crystal capacitor in a first period;

providing a data voltage to the first terminal of the liquid crystal capacitor and providing a set voltage to the second terminal of the liquid crystal capacitor in a second period; and providing the common voltage to the first terminal of the liquid crystal capacitor in a third period, wherein the first period precedes the second period, and the second period precedes the third period, wherein the liquid crystal pixel circuit further comprises a first switch, a second switch, a third switch, and a fourth switch that are respectively controlled by a first gate signal, a second gate signal, a third gate signal, and a fourth gate signal; and the driving method further comprises:

in the first period, the first gate signal forming a first positive pulse wave to turn on the first switch; the third gate signal being an enabling level to turn on the third switch; and the common voltage being transmitted to the first terminal and the second terminal of the liquid crystal capacitor by turning on the first switch and the third switch;

in the second period, the second gate signal and the fourth gate signal forming a second positive pulse wave to turn on the second switch and the fourth switch; the third gate signal forming a negative pulse wave to turn off the third switch; the data voltage being transmitted to the first terminal of the liquid crystal capacitor by turning on the second switch and the set voltage being transmitted to the second terminal of the liquid crystal capacitor by turning on the fourth switch; and in the third period, the third gate signal being the enabling level to turn on the third switch; the first gate signal and the second gate signal being a disabling level to turn off the first switch, the second switch, and the fourth switch; and the common voltage being transmitted to the first terminal of the liquid crystal capacitor by turning on the third switch.

12. The driving method according to claim 11, wherein the liquid crystal capacitor is formed by blue phase liquid crystal, nematic liquid crystal, smectic liquid crystal, or cholesteric liquid crystal.

13. The driving method according to claim 11, wherein the driving method of the liquid crystal pixel circuit is adapted for a TN liquid crystal display panel, a VA liquid crystal display panel, an IPS liquid crystal display panel, or a FFS liquid crystal display panel.

* * * * *